US011290792B2

(12) United States Patent
Cai et al.

(10) Patent No.: US 11,290,792 B2
(45) Date of Patent: Mar. 29, 2022

(54) LOUDSPEAKER ASSEMBLY AND ELECTRONIC DEVICE

(71) Applicant: VIVO MOBILE COMMUNICATION CO., LTD., Guangdong (CN)

(72) Inventors: Qiong Cai, Chang'an Dongguan (CN); Junwen Li, Chang'an Dongguan (CN)

(73) Assignee: VIVO MOBILE COMMUNICATION CO., LTD., Chang'an Dongguan (CN)

( * ) Notice: Subject to any disclaimer, the term of this patent is extended or adjusted under 35 U.S.C. 154(b) by 0 days.

(21) Appl. No.: 16/968,859

(22) PCT Filed: Feb. 2, 2019

(86) PCT No.: PCT/CN2019/074565
§ 371 (c)(1),
(2) Date: Aug. 10, 2020

(87) PCT Pub. No.: WO2019/154359
PCT Pub. Date: Aug. 15, 2019

(65) Prior Publication Data

US 2021/0014587 A1 Jan. 14, 2021

(30) Foreign Application Priority Data

Feb. 11, 2018 (CN) ..... 201810140877.9

(51) Int. Cl.
*H04R 1/02* (2006.01)

(52) U.S. Cl.
CPC ..... *H04R 1/02* (2013.01)

(58) Field of Classification Search
CPC ..... H04R 1/02; H04R 1/2807; H04R 1/2846; H04R 1/2849; H04R 1/2815; H04R 2499/11
See application file for complete search history.

(56) References Cited

U.S. PATENT DOCUMENTS 5,790,679 A * 8/1998 Hawker ..... H04M 1/0202 379/388.02
8,712,086 B2 * 4/2014 Zurek ..... H04M 1/035 381/345

(Continued)

FOREIGN PATENT DOCUMENTS

CN 103220607 A 7/2013
CN 104301849 A 1/2015

(Continued)

OTHER PUBLICATIONS

CN Search Report in Application No. 201810140877.9 dated Nov. 16, 2018.

(Continued)

*Primary Examiner* — Jason R Kurr
(74) *Attorney, Agent, or Firm* — Maschoff Brennan

(57) ABSTRACT

Provided are a loudspeaker assembly and an electronic device. The loudspeaker assembly includes: a housing having an internal cavity; a loudspeaker unit built in the internal cavity and including a loudspeaker diaphragm; and a separator provided in the internal cavity, the internal cavity being divided by the separator and the loudspeaker unit into a first cavity and a second cavity; where the housing has a through hole, the first cavity communicates with an exterior of the housing by the through hole, and the loudspeaker diaphragm is positioned in the first cavity; and the separator is provided with a balance hole in communication with the first cavity, and the second cavity is in communication with the first cavity through the balance hole.

7 Claims, 2 Drawing Sheets

(56) References Cited

U.S. PATENT DOCUMENTS

| | | | | |
|---|---|---|---|---|
| 9,408,009 | B1 * | 8/2016 | Witte | H04R 1/44 |
| 10,567,858 | B2 | 2/2020 | Han et al. | |
| 2004/0071309 | A1 | 4/2004 | Furuya et al. | |
| 2006/0239487 | A1 | 10/2006 | Barker | |
| 2018/0206011 | A1 * | 7/2018 | Han | H04R 1/2842 |
| 2019/0058933 | A1 | 2/2019 | Huo et al. | |
| 2021/0014587 | A1 | 1/2021 | Cai et al. | |

FOREIGN PATENT DOCUMENTS

| | | | |
|---|---|---|---|
| CN | 204906708 | U | 12/2015 |
| CN | 105592389 | A | 5/2016 |
| CN | 205622852 | U | 10/2016 |
| CN | 106454627 | A | 2/2017 |
| CN | 106454663 | A | 2/2017 |
| CN | 206136253 | U | 4/2017 |
| CN | 206332841 | U | 7/2017 |
| CN | 108391188 | A | 8/2018 |
| WO | 2017/041514 | A1 | 3/2017 |

OTHER PUBLICATIONS

Written Opinion and International Search Report in Application No. PCT/CN2019/074565 dated Aug. 20, 2020.

Extended European Search Report issued in corresponding application No. 19750943.3, dated Feb. 15, 2021.

* cited by examiner

LOUDSPEAKER ASSEMBLY AND ELECTRONIC DEVICE

CROSS-REFERENCE TO RELATED APPLICATION

The present application is a U.S. national phase application of a PCT Application No. PCT/CN2019/074565 filed on Feb. 2, 2019, which claims a priority to the Chinese patent application No. 201810140877.9 filed in China on Feb. 11, 2018, a disclosure of which is incorporated herein by reference in its entirety.

TECHNICAL FIELD

The present disclosure relates to the field of communication technologies, in particular to a loudspeaker assembly and an electronic device.

BACKGROUND

A loudspeaker assembly is an important electroacoustic transduction component in an electronic device with audio playback functions, such as a speaker box, a cell phone, or an earphone. In a conventional loudspeaker assembly of an electronic device, a loudspeaker unit is assembled into an enclosed housing to form a BOX assembly. The interior of the housing is divided into a front housing cavity and a rear housing cavity by a separator member and the loudspeaker unit. A balance hole is opened on a side wall of the housing at a location corresponding to the rear housing cavity. The airflow internal to the rear housing cavity needs to be exchanged with the airflow internal to the electronic device through the balance hole, and then with the atmosphere external to the electronic device through slits on the electronic device, so as to allow air-pressure balance and heat dissipation of the rear housing cavity. However, as the sealing of conventional electronic devices improves, the exchange between the airflow internal to the electronic device and the atmosphere external to electronic device is hampered, leading indirectly to hampered exchange between the airflow in the rear housing cavity and the atmosphere external to the electronic device, which causes poor ventilation in the rear housing cavity, and consequently causes the problem of air-pressure imbalance and poor heat dissipation in the rear housing cavity which degrades the performance of the loudspeaker assembly.

SUMMARY

In embodiments of the present disclosure, a loudspeaker assembly and an electronic device are provided, to solve the problem in the related art of air-pressure imbalance and poor heat dissipation in the rear housing cavity due to poor ventilation in the rear housing cavity.

The present disclosure solves the technical problem mentioned above by the following technical solutions.

In an aspect of embodiments of the present disclosure, a loudspeaker assembly applied to an electronic device is provided. The loudspeaker assembly includes: a housing having an internal cavity; a loudspeaker unit built in the internal cavity and including a loudspeaker diaphragm; and a separator provided in the internal cavity, the internal cavity being divided by the separator and the loudspeaker unit into a first cavity and a second cavity; where the housing has a through hole, the first cavity communicates with an exterior of the housing by the through hole, and the loudspeaker diaphragm is positioned in the first cavity; and the separator is provided with a balance hole in communication with the first cavity, and the second cavity is in communication with the first cavity through the balance hole.

Further, the separator includes a first separator member and a second separator member, the balance hole being provided on the first separator member and/or the second separator member; where the first separator member has a first end attached to an inner side wall of the housing facing away from the loudspeaker diaphragm and a second end attached to the loudspeaker unit; and the second separator member has a first end attached to an inner side wall of the housing facing the loudspeaker diaphragm and a second end attached to the loudspeaker unit.

Further, when the balance hole is provided on the first separator member, the loudspeaker unit divides the second cavity into a first sub-cavity and a second sub-cavity, the first sub-cavity being in communication with the second sub-cavity through a communication channel.

Further, the first separator member and the second separator member are injection molded structures.

Further, the first separator member and/or the second separator member provided with a balance hole has an L shape.

Further, the balance hole is covered with a water-proof membrane.

Further, the loudspeaker assembly is a side sound-emission loudspeaker assembly.

In another aspect of embodiments of the present disclosure, an electronic device including the loudspeaker assembly described above is provided, where a sound-outlet hole is opened on the casing of the electronic device, and the through hole on the housing of the loudspeaker assembly is arranged opposite to the sound-outlet hole.

In the loudspeaker assembly according to an embodiment of the present disclosure, a balance hole is opened on the separator inside the housing, so that the rear housing cavity (i.e., the second cavity) can communicate with the exterior of the electronic device through the front housing cavity (i.e. the first cavity) to allow air exchange, thereby ensuring the air-pressure balance and heat dissipation in the rear housing cavity and consequently ensuring the performance of the loudspeaker assembly.

BRIEF DESCRIPTION OF THE DRAWINGS

In order to explain the technical solutions in the embodiments of the present disclosure more clearly, the drawings required in description of the embodiments of the present disclosure will be briefly described below. Apparently, the drawings in the following description illustrate merely some embodiments of the present disclosure, and other drawings can be obtained based on these drawings without any creative effort by those of ordinary skill in the art.

DETAILED DESCRIPTION

The technical solutions in the embodiments of the present disclosure will be described clearly and completely below with reference to the drawings in the embodiments of the present disclosure. Apparently, the described embodiments are merely some of the embodiments of the present disclosure and not all of them. Based on the embodiments in the present disclosure, any other embodiment obtained by those of ordinary skill in the art without any creative effort shall fall within the scope of the present disclosure.

In an aspect of embodiments of the present disclosure, a loudspeaker assembly, in particular a side sound-emission loudspeaker assembly, is provided.

Figure 1:
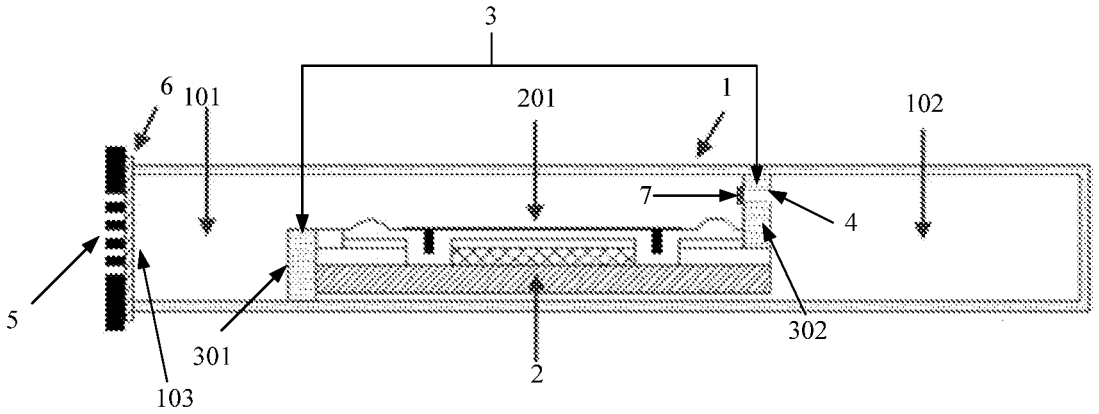
FIG. 1 illustrates a first sectional view of a loudspeaker assembly according to an embodiment of the present disclosure.
Figure 2:
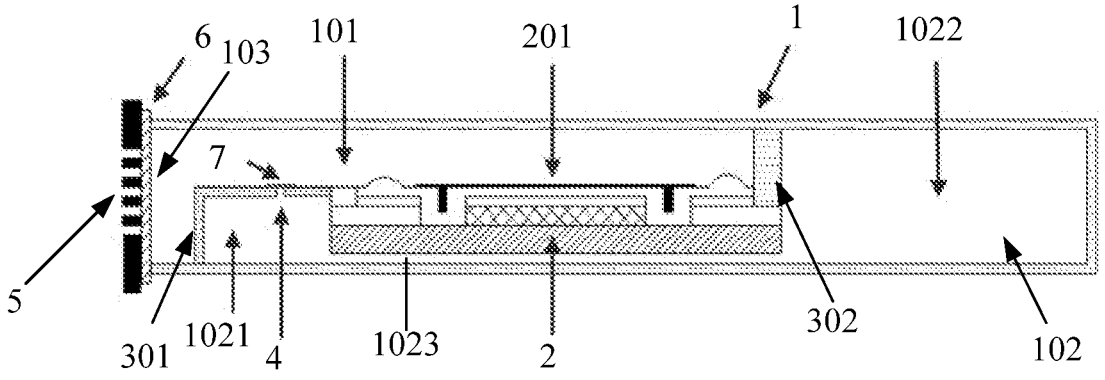
FIG. 2 illustrates a second sectional view of a loudspeaker assembly according to an embodiment of the present disclosure.
Figure 3:
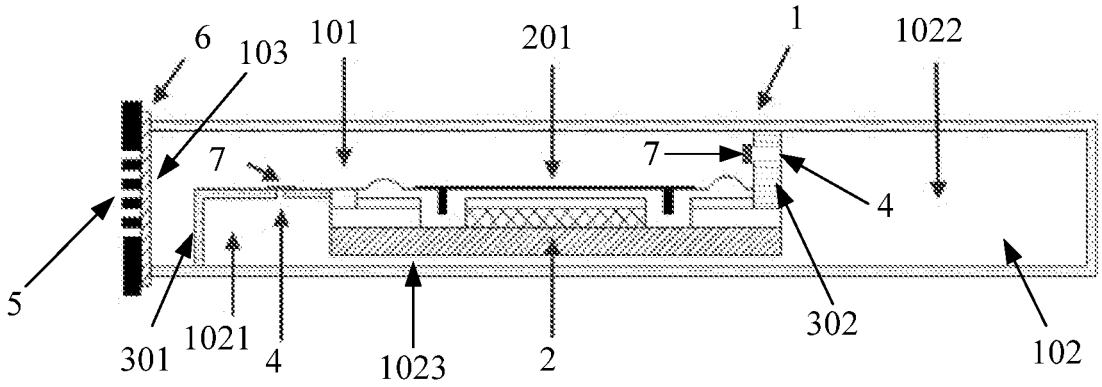
FIG. 3 illustrates a third sectional view of a loudspeaker assembly according to an embodiment of the present disclosure.

As shown in FIG. 1 to FIG. 3, the loudspeaker assembly includes a housing 1 and a loudspeaker unit 2 provided in the housing 1.

An internal cavity is formed inside the housing 1. The loudspeaker unit 2 is built in the internal cavity. A separator 3 is also provided in the internal cavity. The internal cavity is divided by the separator 3 and the loudspeaker unit 2 into a first cavity 101 (corresponding to a front cavity of the housing 1) and a second cavity 102 (corresponding to a rear cavity of the housing 1).

A loudspeaker diaphragm in the loudspeaker unit 2 is positioned in the first cavity 101. The housing 1 has through hole 103, the first cavity 101 communicates with an exterior of the housing 1 by the through hole 103. The first cavity 101 forms a sound-emission channel, and the sound emitted from the loudspeaker unit 2 passes through the first cavity 101 to propagate out of the electronic device via the through hole 103 on the housing 1. Typically, the through hole 103 on the housing 1 is arranged opposite to a sound-outlet hole 5 on the electronic device, so as to enable better outward propagation of sound. To prevent dust from entering the electronic device via the sound-outlet hole 5, a dust screen 6 is also provided on the inner side of the sound-outlet hole 5.

In an embodiment of the present disclosure, to ensure air-pressure balance and heat dissipation in the second cavity 102, a balance hole 4 in communication with the first cavity 101 is opened on the separator 3. The second cavity 102 is in communication with the first cavity 101 via the balance hole 4.

As the first cavity 101 can communicate with the exterior of the electronic device by the through hole 103 on the housing 1, the second cavity 102 can also communicate with the exterior of the electronic device indirectly through the first cavity 101. In this way, better air-pressure balance and heat dissipation in the second cavity 102 is ensured, without having to exchange air with the airflow internal to the electronic device through the balance hole 4 and then with the atmosphere external to the electronic device through slits on the electronic device.

Preferably, the balance hole 4 is covered with a waterproof membrane 7, so as to prevent external water from entering the second cavity 102 as well as control the amount of air allowed into the second cavity 102.

Specifically, as shown in FIG. 1 to FIG. 3, the separator 3 includes a first separator member 301 and a second separator member 302.

The first separator member 301 has a first end attached to an inner side wall of the housing 1 facing away from the loudspeaker diaphragm, and a second end attached to the loudspeaker unit 2. The second separator member 302 has a first end attached to an inner side wall of the housing 1 facing the loudspeaker single diaphragm, and a second end attached to the loudspeaker unit 2. In this way, the first separator member 301, the second separator member 302, and the loudspeaker unit 2 divide the internal cavity of the housing 1 into a first cavity 101 and a second cavity 102.

The balance hole 4 is provided on the first separator member 301 and/or the second separator member 302, and a specific configuration thereof may be designed according to practical requirements.

Specifically, FIG. 1 is a schematic view of a structure in which the balance hole 4 is opened only on the second separator member 302. In this case, the second separator member 302 may keep its original structure and shape, or preferably has the L-shaped structural section similar to the first separator member 301 as shown in FIG. 2, or may be designed according to practical requirements, and no limitation is made in this respect in embodiments of the present disclosure.

Specifically, FIG. 2 is a schematic view of a structure in which the balance hole 4 is only opened on the first separator member 301. In this case, the loudspeaker unit 2 divides the second cavity 102 into a first sub-cavity 1021 and a second sub-cavity 1022.

It can be seen from FIG. 1 that, a lower end face of the loudspeaker unit 2 is close to the inner side wall of the housing 1. To ensure that there is sufficient space on the first separator member 301 to open the balance hole 4, the first sub-cavity 1021 is formed between the first separator member 301, the inner side wall of the housing 1, and the loudspeaker unit 2, and the second sub-cavity 1022 is formed between the loudspeaker unit 2, the second separator member 302, and the inner side wall of the housing 1. The first sub-cavity 1021 is in communication with the second sub-cavity 1022 through a communication channel 1023.

In terms of the structure and shape, the first separator member preferably has the L-shaped structure shown in the drawings. The balance hole 4 may be provided on the horizontal surface of the first separator member 301, or on the vertical surface of the first separator member 301. It is appreciated that the structure and shape of the first separator member 301 may be designed according to practical requirements and are not limited to those shown in the drawings.

Specifically, FIG. 3 is a schematic view of a structure in which the balance hole 4 is opened on both the first separator member 301 and the second separator member 302. The structure and shape of the first separator member 301 and the second separator member 302 can be designed according to practical requirements and are not limited to those shown in the drawings. No limitation is made in this respect in embodiments of the present disclosure. Of course, in terms of the structure and shape, the first separator member 301 may preferably have the L-shaped structure shown in the drawings.

Further, the first separator member 301 and the second separator member 302 are injection molded structures, thereby a molding process thereof is simple and cost is low.

In summary, in the loudspeaker assembly according to an embodiment of the present disclosure, a balance hole 4 is opened on the separator inside the housing 1, so that the rear cavity of the housing 1 (i.e., the second cavity 102) can communicate with the exterior of the electronic device through the front cavity of the housing 1 (i.e., the first cavity 101) to allow air exchange, thereby ensuring the air-pressure balance and heat dissipation in the rear cavity of the housing 1 and consequently ensuring the performance of the loudspeaker assembly.

In another aspect of embodiments of the present disclosure, an electronic device including the foregoing loudspeaker assembly is provided.

A sound-outlet hole 5 is opened on the casing of the electronic device, and the through hole 103 on the housing 1 of the loudspeaker assembly is arranged opposite to the sound-outlet hole 5.

The electronic device according to an embodiment of the present disclosure includes, without limitation, a cell phone, a tablet computer, a personal digital assistant, a speaker box, an earphone, and the like.

In the loudspeaker assembly of the electronic device according to an embodiment of the present disclosure, a balance hole 4 is opened on the separator inside the housing 1, so that the rear cavity of the housing 1 (i.e., the second cavity 102) can communicate with the exterior of the electronic device through the front cavity of the housing 1 (i.e. the first cavity 101) to allow air exchange, thereby ensuring the air-pressure balance and heat dissipation in the rear cavity of the housing 1 and consequently ensuring the performance of the loudspeaker assembly.

In the description of the present disclosure, it should be understood that the orientational or positional relationships denoted by the terms "central", "longitudinal", "transversal", "length", "width", "thickness", "upper", "lower", "front", "rear", "left", "right", "vertical", "horizontal", "top", "bottom", "inner", and "exterior" are orientational or positional relationships based on the drawings, and are merely for ease and simplicity of description of the present disclosure and are not intended to indicate or imply that the device or element referred to must have a particular orientation or be constructed and operated in a particular orientation; and therefore should not be understood as limitation on the present disclosure.

In addition, the terms "first" and "second" are only used for illustrative purposes, and should not be understood as indicating or implying relative importance or implicitly indicating the quantity of the designated technical features. Therefore, the features defined with "first" and "second" may include one or more of the features explicitly or implicitly. In the description of the present disclosure, the term "a plurality of" means at least two, e.g., two, three, etc., unless otherwise specifically defined.

In the present disclosure, unless otherwise specified and defined, the terms such as "installed", "connected", "attached" and "fixed" should be understood in a broad sense, for example, they can refer to a fixed connection, a detachable connection or integration; they can be mechanical connection, electrical connection or communication with each other; they can be direct connection or indirect connection via an intermediate medium, or can be internal communication between two elements or interaction between two elements. For those of ordinary skill in the art, the specific meanings of the above terms in the present disclosure can be derived according to specific situations.

In this disclosure, unless otherwise explicitly specified and defined, the expression that a first feature is "on" or "under" a second feature may mean direct contact between the first and second features, or may mean indirect contact between the first and second features via another feature. Furthermore, the expression that a first feature "above", "on", or "on top of" a second feature means that the first feature is directly above or obliquely above the second feature, or simply means that the first feature is higher in level than the second feature. The expression that the first feature is "below", "under", or "beneath" the second feature means that the first feature is directly below or obliquely below the second feature, or simply means that the first feature is lower in level than the second feature.

All the embodiments in this specification are described in a progressive way, and each embodiment focuses on the differences from other embodiments. The same and similar parts among the embodiments can be referred to each other.

Although preferred embodiments of the embodiments of the present disclosure have been described, those skilled in the art can make additional changes and modifications to these embodiments based on the basic inventive concepts. Therefore, the appended claims are intended to be interpreted as including the preferred embodiments and all changes and modifications falling within the scope of the embodiments of the present disclosure.

Finally, it should be noted that in this specification, relational terms such as "first" and "second" are intended merely to distinguish one entity or operation from another entity or operation, and do not necessarily require or imply any such actual relationship or order between these entities or operations. Furthermore, the terms "including", "include" or any other variant thereof are intended to cover non-exclusive inclusion, so that a process, method, article or terminal device including a series of elements includes not only those elements, but also other elements not explicitly listed, or elements inherent to such a process, method, article or terminal device. Without further restrictions, the elements defined by the expression "including one . . . " do not exclude the presence of other identical elements in the process, method, article or terminal device including the elements.

Described above are preferred embodiments of the present disclosure. It should be noted that some improvements and modifications can be made by those of ordinary skill in the art without departing from the principles described in the present disclosure, and these improvements and modifications shall fall within the scope of the present disclosure.

What is claimed is:

1. A loudspeaker assembly, applied to an electronic device, comprising:

a housing having an internal cavity;

a loudspeaker unit built in the internal cavity and including a loudspeaker diaphragm; and a separator provided in the internal cavity, the internal cavity being divided by the separator and the loudspeaker unit into a first cavity and a second cavity;

wherein the housing has a through hole, the first cavity communicates with an exterior of the housing by the through hole, and the loudspeaker diaphragm is positioned in the first cavity;

and the separator is provided with a balance hole in communication with the first cavity, and the second cavity is in communication with the first cavity through the balance hole, wherein the balance hole is covered with a water-proof membrane to control an amount of air allowed into the second cavity.

2. The loudspeaker assembly according to claim 1, wherein the separator comprises first separator member and a second separator member, the balance hole is provided on the first separator member and/or the second separator member;

the first separator member has a first end attached to an inner side wall of the housing facing away from the loudspeaker diaphragm, and the first separator member has a second end attached to the loudspeaker unit; and the second separator member has a first end attached to an inner side wall of the housing facing the loudspeaker diaphragm, and the second separator member has a second end attached to the loudspeaker unit.

3. The loudspeaker assembly according to claim 2, wherein when the balance hole is provided on the first separator member, the loudspeaker unit divides the second cavity into a first sub-cavity and a second sub-cavity, and the first sub-cavity communicates with the second sub-cavity through a communication channel.

4. The loudspeaker assembly according to claim 2, wherein the first separator member and the second separator member are injection molded structures.

5. The loudspeaker assembly according to claim 2, wherein the first separator member and/or second separator member provided with the balance hole has an L shape.

6. The loudspeaker assembly according to claim 1, wherein the loudspeaker assembly is a side sound-emission loudspeaker assembly.

7. An electronic device, comprising the loudspeaker assembly according to claim 1, wherein a sound-outlet hole is opened on a casing of the electronic device, and the through hole on the housing of the loudspeaker assembly is arranged opposite to the sound- outlet hole.

* * * * *